United States Patent [19]

Kito et al.

[11] Patent Number: 4,559,414

[45] Date of Patent: Dec. 17, 1985

[54] ELECTROLYTIC CORROSION RESISTANT INSULATOR

[75] Inventors: Kuniji Kito, Nagoya; Akihiro Watanabe, Hashima; Shigeo Mori, Kuwana, all of Japan

[73] Assignee: NGK Insulators, Ltd., Nagoya, Japan

[21] Appl. No.: 638,366

[22] Filed: Aug. 7, 1984

[30] Foreign Application Priority Data

Aug. 26, 1983 [JP] Japan ..... 58-156629

[51] Int. Cl.[4] ..... H01B 17/08; H01B 17/38

[52] U.S. Cl. ..... 174/196; 174/182; 174/211

[58] Field of Search ..... 174/182, 189, 196, 211

[56] References Cited

FOREIGN PATENT DOCUMENTS 209031 7/1957 Australia ..... 174/211

1025554 4/1966 United Kingdom ..... 174/211

*Primary Examiner*—Laramie E. Askin

*Attorney, Agent, or Firm*—Parkhurst & Oliff

[57] ABSTRACT

An electrolytic corrosion resistant insulator includes an insulator body having a cavity therein and a metallic pin having a portion located within the cavity and secured therein by cement. A sacrificial anode surrounds the pin at an intermediate portion thereof and protrudes radially from the pin. Part of the sacrificial anode is covered by the cement. An electric insulating film of a synthetic resin is lamination-attached to the pin and covers substantially the entire outer surface of the portion of the pin which is secured within the cavity by the cement. The electric insulating film also covers approximately half of the upper portion of the sacrificial anode. The electric insulating film is free from pin holes and has a thickness between 200 and 600 micrometers.

10 Claims, 2 Drawing Figures

ELECTROLYTIC CORROSION RESISTANT INSULATOR

BACKGROUND OF THE INVENTION (1) Field of the Invention

The present invention relates to an improvement on an electrolytic corrosion resistant insulator for use in a direct current transmission line and the like.

(2) Description of the Prior Art

In order to prevent the electrolytic corrosion of the pin in an insulator due to electric current leakage and the resultant damage to an insulator in a DC transmission line, there has been used an electrolytic corrosion resistant insulator in which a sacrificial anode is projectingly provided around the outer periphery of the pin at an intermediate position thereof in the boundary with the cement, where the density of the current leakage is the largest. However, such an insulator has the problems that when the cement into which the pin is embedded is wetted under a severely contaminating environment and only the surface of the cement is half-dried under the influence of the wind or the like, the difference in electric resistance between the sacrificial anode and the pin body embedded in the cement becomes a minimum among the electric resistance between the insulator body and the pin, resulting in the leakage current to flow through the pin body so as to electrolytically corrode the pin. Furthermore, a large internal pressure stress is produced in the interior of the electric insulator by the rust formed through the electrolytic corrosion to thereby cause the electric insulator to break.

SUMMARY OF THE INVENTION

It is therefore an object of the present invention to provide an electrolytic corrosion resistant insulator which eliminates the above problems, and is free from the electrolytic corrosion of a pin even under such special use conditions as mentioned above.

It is another object of the invention to provide an electrolytic corrosion resistant insulator which is prevented from being broken due to the formation of rust.

According to the present invention, there is a provision of the electrolytic corrosion resistant insulator in which the upper portion of a pin is buried in and secured to cement filled in an insulator body. A sacrificial anode, a portion of which is buried in the cement, is protrusively formed at the intermediate position of the pin, and an electric insulation film made of a synthetic resin is formed on the surface of the pin at a position where the pin is buried in the cement and of the upper roughly half portion of the sacrificial anode.

These and other objects, features, and advantages of the present invention will be well appreciated upon reading the following description of the invention when taken in conjunction with the attached drawing with understanding that some modifications, variations and changes could be easily made by one skilled in the art to which the invention pertains without departing from the spirit of the invention or the scope of the claims appended hereto.

DESCRIPTION OF THE PREFERRED EMBODIMENT

The present invention will be described more in detail with reference to a specific embodiment according to the present invention.

Figure 1:
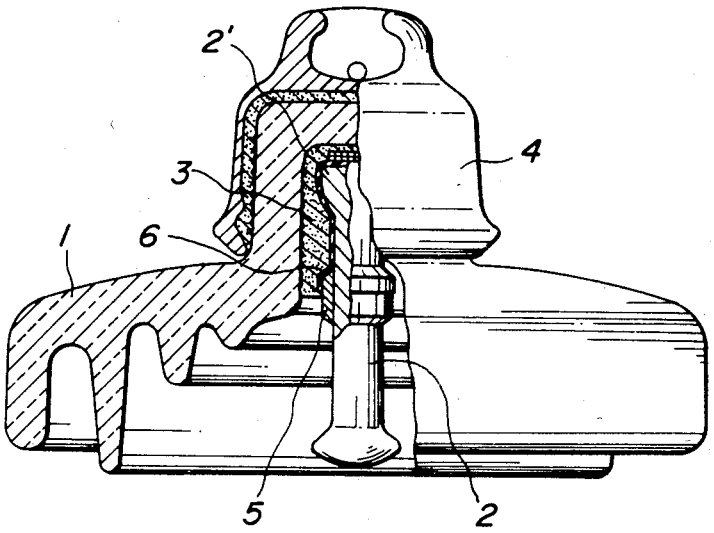
FIG. 1 is a partially broken front view of an embodiment according to the present invention.
Figure 2:
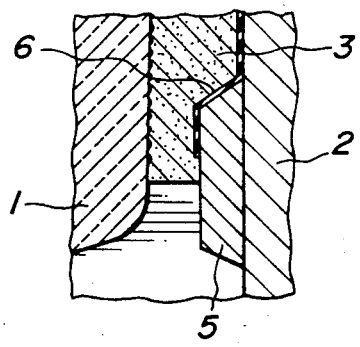
FIG. 2 is a vertical sectional view of the principal portion of the embodiment of FIG. 1.

In FIGS. 1 and 2, a reference numeral 1 is an electric insulator body made of porcelain, and a reference numeral 2 is a pin which is inserted into and secured to the insulator body 1 from the lower side in such a state that a swelling end portion 2′ and an upper end portion continuing therefrom are buried into a cement 3 filled inside of the insulator body 1. A reference numeral 4 is a socket cap which is positioned on the head portion of the insulator body 1. Around an intermediate portion of the pin 2 is cast a sacrificial anode 5 a part of the upper portion of which is buried in the cement 3 in the insulator body, and the sacrificial anode 5 is integrally and protrusively formed onto the pin body according to an appropriate joining method such as brazing. An electric insulation film 6 of a synthetic resin such as polyamide resin, epoxy resin, polyethylene, polypropylene, ABS resin, vinyl, acrylic acid resin or the like is lamination-attached onto the surface of the pin 2 at a portion of the pin which is buried in the cement 3. More particularly, the synthetic resin is attached to the surface of the upper portion from the swelled end portion 2′ to the upper roughly half portion of the sacrificial anode 5 at the intermediate portion of the pin 2. If the electric insulation film 6 is too thin, pin holes are likely to be produced and its electric insulation characteristics are deteriorated, while if it is too thick, the mechanical strength of the electric insulation film 6 drops. Thus, the thickness of the electric insulation film 6 is preferably not less than 200 μm but not more than 600 μm. If it is in such a thickness range, the film is free from pin holes. The lower edge of the electric insulation film may be flush with the lower surface of the cement, or located slightly higher than the lower surface of the cement, or exposed to the atmosphere side slightly beyond the lower surface of the cement. However, if the distance between the lower edge of the electric insulation film 6 and the lower surface of the cement exceeds 5 mm when the film lower edge is on the side of the cement, the length of the contact between the sacrificial anode 5 and the cement 3 is too large, while on the contrary, if the lower edge of the electric insulation film 6 extends to the atmosphere side beyond the lower surface of the cement 3 by not shorter than 10 mm, the leakage current is unfavorably difficult to flow to the sacrificial anode 5.

In the thus constructed insulator, since the pin 2 is secured to the insulator body 1 in such a state that a portion from the upper end of the pin 2 to a part of the sacrificial anode 5 protrusively formed at the intermediate portion thereof is buried in the cement 3 filled in the insulator body 1 and the electric insulation film 6 made of the synthetic resin free from pin holes is formed on the surface of the pin at a portion which is buried into the cement 3, the electric resistance between the insulator body 1 and the pin 2 is a minimum at the sacrificial anode 5 even in the special conditions as mentioned above, the whole cement is in a wet state, and only the surface of the cement is half-dried by the influence of the wind and the like. Thus, the leakage current flows into the sacrificial anode 5 protrusively formed around the outer periphery of the pin 2 through the surface of the cement. Accordingly, when the sacrificial anode 5 undergoes electrolytic corrosion, the pin 2 is electrochemically shielded and is prevented from being electrolytically corroded. Further, since the electric insulation film 6, which is free from pin holes, is formed on the pin 2 at the upper portion which is buried in the cement, the leakage current flows only at the surface of the sacrificial anode 5 in the vicinity of the cement surface, so that rust is formed by the electrolytic corrosion only in an extremely narrow range of the sacrificial anode 5 near the surface of the cement. Therefore, no large internal stress is developed in the interior of the insulator body 1, so that the possibility of the insulator body 1 being broken is ameliorated.

As obvious from the foregoing explanation, since the sacrificial anode, a part of which is buried in the cement, is protrusively formed at the intermediate portion of the pin and the electric insulation film of a synthetic resin is formed on the surface of the pin at the portion which is buried in the cement, even under the special conditions, the electrolytic corrosion of the pin is prevented and rust is formed only in an extremely narrow range of the current flowing anode in the vicinity of the cement. Therefore, the insulator body is prevented from being damaged by a large internal stress imposed upon the interior of the insulator body due to the rust formation. Accordingly, the present invention contributes to the development of the industry through resolution of the defects of conventional insulators.

What is claimed is:

1. An electrolytic corrosion resistant insulator comprising:

an insulator body having a cavity therein;

a pin located within said cavity of the insulator body, a portion of said pin being secured therein by cement;

a sacrificial anode surrounding said pin at an intermediate portion thereof, said sacrificial anode being partially covered by said cement and protruding radially from said pin; and a synthetic resin electric insulating film being lamination-attached to the pin and covering substantially the entire outer surface of the portion of the pin which is secured within said cavity by cement, said electric insulating film also covering a portion of said sacrificial anode.

2. The electrolytic corrosion resistant insulator according to claim 1, wherein the electric insulating film is free from pin holes.

3. The electrolytic corrosion resistant insulator according to claim 2, wherein the electric insulating film comprises a material selected from the group consisting of polyamide resin, epoxy resin, polyethylene, polypropylene, ABS resin, vinyl and acrylic acid resin.

4. The electrolytic corrosion resistant insulator according to claim 1, wherein a lower edge of the electric insulating film terminates within the cement, and a distance between the lower edge of the electric insulating film and a lower surface of the cement is not greater than 5 mm.

5. The electrolytic corrosion resistant insulator according to claim 4, wherein the thickness of the electric insulating film is from 200 μm to 600 μm.

6. The electrolytic corrosion resistant insulator according to claim 1, wherein a lower edge of the electric insulating film terminates outside of said cement beyond a lower surface of the cement, and a distance between the lower edge of the electric insulating film and the lower surface of the cement is not greater than 10 mm.

7. The electrolytic corrosion resistant insulator according to claim 5, wherein the thickness of the electric insulating film is from 200 μm to 600 μm.

8. The electrolytic corrosion resistant insulator according to claim 1, wherein the thickness of the electric insulating film is from 200 μm to 600 μm.

9. The electrolytic corrosion resistant insulator according to claim 1, wherein said electric insulating film covers approximately half of said sacrificial anode, which half being closest to said cement.

10. An electrolytic corrision resistant insulator comprising:

an insulator body having a cavity therein;

a pin located within said cavity of the insulator body, a portion of said pin being secured therein by cement;

a sacrificial anode surrounding said pin at an intermediate portion thereof, said sacrificial anode being partially covered by said cement and protruding radially from said pin; and a synthetic resin electric insulating film being free from pin holes, comprising a material selected from the group consisting of polyamide resin, epoxy resin, polyethylene, polypropylene, ABS resin, vinyl and acrylic acid resin, said film being lamination-attached to the pin and covering substantially the entire outer surface of the portion of the pin which is secured within said cavity by cement, said electric insulating film also covering approximately half of said sacrificial anode, which half being closest to said cement, said electric insulating film being from 200 μm to 600 μm thick.

* * * * *